US009399364B2

(12) United States Patent
Elgee et al.

(10) Patent No.: US 9,399,364 B2
(45) Date of Patent: Jul. 26, 2016

(54) NON-PRINTED FEATURES ON PRINT MEDIA FOR PRINTING WITH A DESIRED RESOLUTION

(75) Inventors: Steven B Elgee, Portland, OR (US); Lonnie W. Adelman, La Jolla, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 626 days.

(21) Appl. No.: 13/486,165

(22) Filed: Jun. 1, 2012

(65) Prior Publication Data

US 2013/0323424 A1 Dec. 5, 2013

(51) Int. Cl.

| | |
|---|---|
| ***B41J 29/393*** | (2006.01) |
| ***B41M 5/00*** | (2006.01) |
| ***B41J 11/46*** | (2006.01) |

(52) U.S. Cl.

CPC .. *B41M 5/00* (2013.01); *B41J 11/46* (2013.01)

(58) Field of Classification Search

CPC ..... G06K 15/027
USPC ..... 347/5, 9, 8, 19, 11, 16, 118; 270/52; 382/1

See application file for complete search history.

(56) References Cited

U.S. PATENT DOCUMENTS

| | | | | |
|---|---|---|---|---|
| 4,807,790 | A | 2/1989 | Ushioda | |
| 4,965,597 | A * | 10/1990 | Ohigashi et al. | 347/118 |
| 5,028,040 | A * | 7/1991 | Kalisiak | 270/52.08 |
| 5,138,667 | A * | 8/1992 | Roch | B41F 33/0081 101/181 |
| 5,847,722 | A | 12/1998 | Hackleman | |
| 6,072,587 | A | 6/2000 | Hicks | |
| 6,292,635 | B1 | 9/2001 | Tokairin et al. | |
| 6,325,480 | B1 * | 12/2001 | Moghadam et al. | 347/19 |
| 6,335,084 | B1 | 1/2002 | Biegelsen et al. | |
| 2009/0173764 | A1 | 7/2009 | Land | |

FOREIGN PATENT DOCUMENTS

| | | |
|---|---|---|
| JP | 2000-158731 | 6/2000 |

* cited by examiner

*Primary Examiner* — Lam Nguyen
(74) *Attorney, Agent, or Firm* — Law Office of Robert C. Sismilich

(57) ABSTRACT

In one example, an encoding station of a printing system forms a pattern of non-printed features onto flowing print media. The non-printed features are detected, and timing signals generated from the detected features. The timing signals cause the media to be printed at a desired resolution in the direction of the flow.

21 Claims, 9 Drawing Sheets

NON-PRINTED FEATURES ON PRINT MEDIA FOR PRINTING WITH A DESIRED RESOLUTION

BACKGROUND

In a digital printing system, individual drops or "dots" of a colorant are intended to be precisely deposited in desired locations on the print media, such as paper, to form the image. Precise dot placement allows the printing system to generate high-quality textual output that appears to a viewer nearly identical to that from a typeset font, and high-quality image output that appears to the viewer to be nearly identical to a photograph. Thus the quality of the printed output affects a users perception of the quality and value of the printing system. This is even more the case for high-end digital printing systems, such as web presses often used in commercial printing applications.

DETAILED DESCRIPTION

Figure 1:
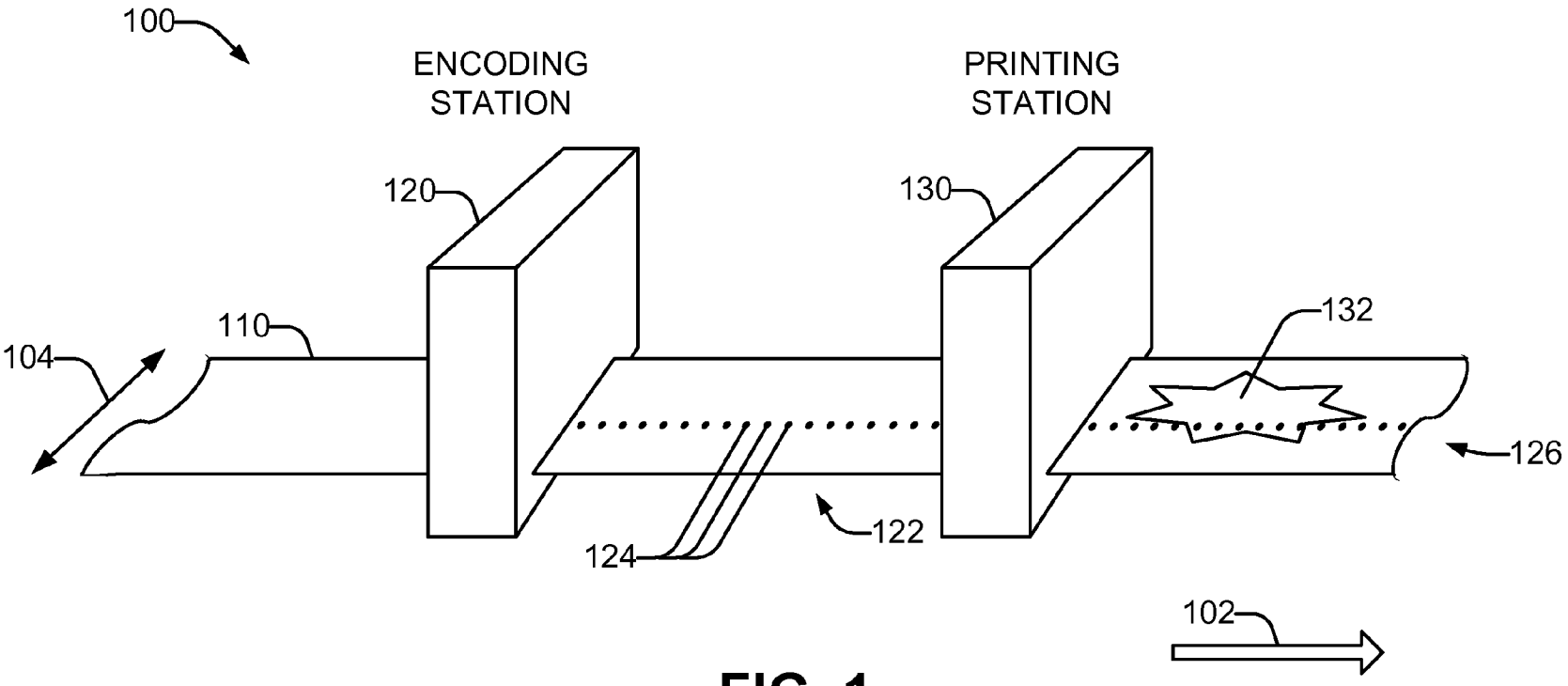
FIG. 1 is a schematic representation of a printing system in accordance with an example of the present disclosure.

As noted in the Background section, web presses are often used in commercial printing applications, which can be more demanding in terms of image quality. Also as noted in the Background section, precise dot placement on the media of the colorant(s) of a digital printing system is related to the perceived quality of the printed output from the printing system.

In a web press, a web of media typically flows continuously through the press during printing, and various processing operations may be performed by stations located at various positions along the web flow. The web of media may be, for example, a long roll of print material of a given width. Possible media material include, but are not limited to, paper of varying content and thicknesses, films, plastics, textiles, transparencies, and other print receiving media.

Dot placement on the media has two dimensions of interest: cross-web (across the width of the roll), and down-web (along the length of the web). Dot placement in the cross-web direction is typically well-controlled, with printing elements precisely disposed along a printbar that spans the width of the media web. The accuracy of dot placement in the down-web direction is typically dependent on precise knowledge of the speed at which the web is flowing past the printbar.

Some web presses use printbars that operate via thermal inkjet printing technology, which offers many advantages. Relative to the plate-based web presses, thermal inkjet technology enables on-the-fly printing from source files, allow jobs to be mixed down the web since plate changes are eliminated, increase press utilization by eliminating the downtime associated with plate changes, and in some cases costs less to own and run. Since thermal inkjet technology emits drops of the various colorants by controllably emitting a colorant fluid which is typically water-based, the dots deposited on the media have significant water content. Certain media types, paper for example, absorb the water and expand. The amount of expansion depends on the media type, its ambient moisture content, and the amount of ink printed. The opposite effect, contraction or shrinkage, can subsequently occur as the water evaporates over time or upon heating of the media. Expansion and contraction can also occur due to other causes. The media may stretch due to tension changes in the media web as it flows through the printing system. Unless the expansion and contraction are accounted for, dot placement can be inaccurate, degrading the image quality of the printed output. Dot placement error may occur in the down-web direction, the cross-web direction, or both.

One technique for controlling down-web dot placement uses metering rollers. However, metering rollers work with dry media, and in any case typically have limited accuracy insufficient for precise down-web dot placement. Another technique uses a pulse train supplied by the control system that drives the paper path as a virtual, or markless, encoder. However, since a virtual technique does not account for the amount of media expansion that occurs as the media is printed on, down-web dot placement error will occur as the media expands. A further technique detects printed marks formed in a lane on the media. However, the lane of printed marks takes up valuable space on the media, space which then becomes unavailable for printing user content. Still another technique performs a calibration run prior to the actual print run. If the calibration run prints output that has the same or similar print density as the actual print run, the printing system can be calibrated such that down-web drop placement errors are minimized for that particular print run. However, the calibration process wastes ink and media, and takes additional time. In addition, the calibration run is not applicable to a different print run, and thus a calibration run is repeated for each different print run.

Referring now to the drawings, there is illustrated an example of a printing system constructed in accordance with the present disclosure which prints on a flowing web of media at a desired resolution in the direction of the flow. Considering now a printing system 100, and with reference to FIG. 1, the printing system 100 receives a continuous web of media 110. The media 110 is printable by the printing system 100 to produce printed content.

The printing system 100 transports the web of media 110 through the printing system 100. Conveyor mechanisms (not shown) receive the web of media 110 from a media supply such as, for example, a roll of media (not shown); move or flow the web in the down-web direction 102 sequentially past the various stations of the printing system 100; and output the web of media 110 from the printing system 100 after printing.

An encoding station 120 receives the flow of media 110 and forms a pattern 122 of non-printed features 124 on the media 110. The non-printed features 124 are formed in at least one lane 126 on the media 110. Each lane 126 is at a particular position in the cross-web direction 104. In some examples, the position of the lane 126 in the cross-web direction 104 may be outside a content printing area of the media 110, such as in a margin or otherwise unprintable or unusable region of the web of media 110. In other examples, as will be discussed subsequently with reference to FIG. 2, the lane 126 may be positioned within a content printing area of the media 110 without the non-printed features 124 degrading the image quality of the printed output to the human eye at a normal viewing distance.

A printing station 130, disposed down-web from the encoding station 120 along the media path, receives the flow of patterned media 110 from the encoding station 120. The printing station 130 detects the various non-printed features 124. From the detected features 124, the printing station 130 generates timing signals that cause the printing station 130 to print content (such as the example content image 132) on the media 110 at a desired printed output resolution in the direction 102 of the flow.

It will be appreciated that the depicted arrangement of the printing system 100 is a schematic example. The distance between the encoding station 120 and the printing station 130 may be large or small. The media path through the printing system 100, while illustrated as a linear path for simplicity, typically includes curvilinear and/or serpentine segments within or between stations. In addition, the different stations may vary in size and/or in the internal media path length through the different stations. While a single printing station 130 has been illustrated, other printing systems 100 may have a plurality of printing stations disposed at different positions along the media path. In addition, some printing systems may have other types of processing stations disposed along the media path down-web of the encoding station 120, for performing other operations such as registration of front and back pages, monitoring of print quality via visioning, removal of water content from the web via drying, and other functions.

Figure 2:
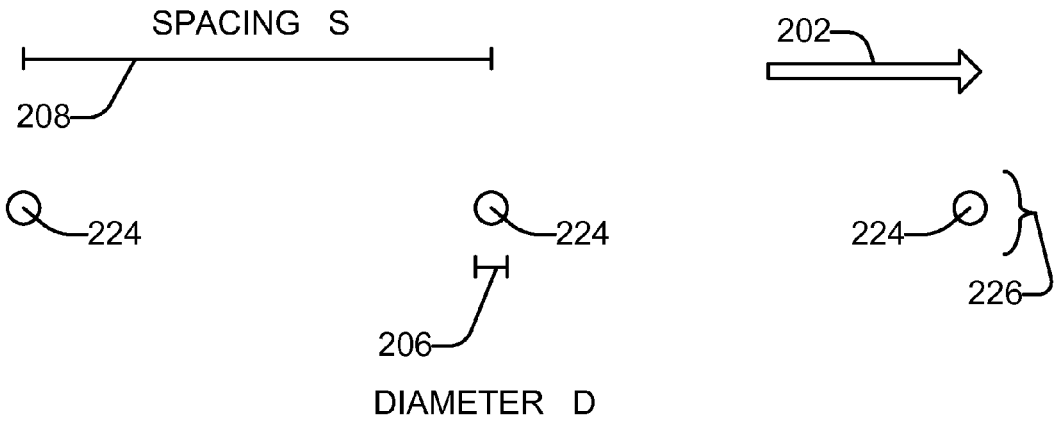
FIG. 2 is a schematic representation of the dimensions and spacing of one type of example non-printed features formed on media by an encoding station of the printing system of FIG. 1 in accordance with an example of the present disclosure.

Considering now in further detail the non-printed features on the media, and with further reference to FIG. 2, in one example each non-printed feature 224 in a lane 226 has a diameter D 206 in the down-web direction 202. Non-printed features 224 in the lane 226 are separated by an integer multiple of a spacing S 208 that is measured from the centerline of two closest features 224 in the lane 226.

In some examples, the non-printed features are holes that are formed in the media. In other examples, the non-printed features are bumps that are embossed in the media. For many media types and situations, non-printed features are advantageous as compared to printed features. For example, non-printed features can be formed more accurately on paper media than can printed features, because paper fibers affect the positioning of printed features more so than non-printed features such as holes or bumps, at least for some printing technologies. In some examples, the non-printed features may be substantially round. Alternatively, the non-printed features may be elliptical, square, rectangular, etc.

In some examples, the diameter D 206 is less than about 100 microns, and the spacing S 208 is a predetermined distance in the range of between about 0.1 inch to 0.5 inch. Non-printed features 224 having this diameter D 206 and spacing S 208 are not visible to the human eye at a normal viewing distance, while still being detectable by various stations of the printing system. Consequently, the lane 226 of the features 224 can be formed at a cross-web position that is within a content printing area of the media without degrading the image quality of the printed output. This can be advantageous in many configurations. For example, the non-printed features 224 do not take valuable space on the media away from the content printing area. The non-printed features 224 do not preclude or prevent the use of the lane 226 for printed content as well. In some examples, the cross-web position of a lane 226 generated by an encoding station may be fixed, which in turn allows the down-web station(s) to use a fixed-position detector to detect the features in that lane.

Figure 3A:
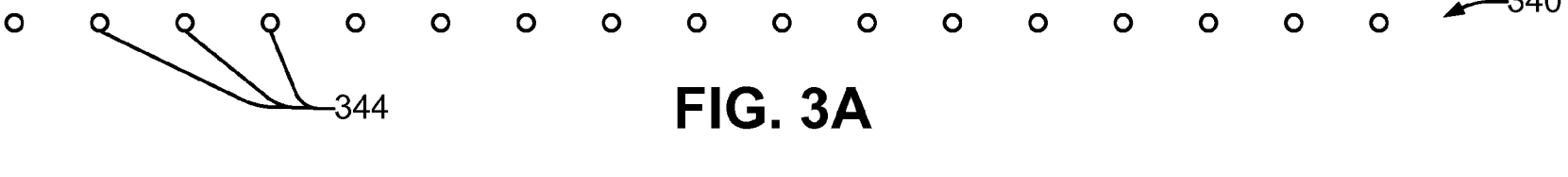
FIGS. 3A-3C are schematic representation of alternative example patterns of the example non-printed features of FIG. 2 in accordance with an example of the present disclosure.
Figure 3B:
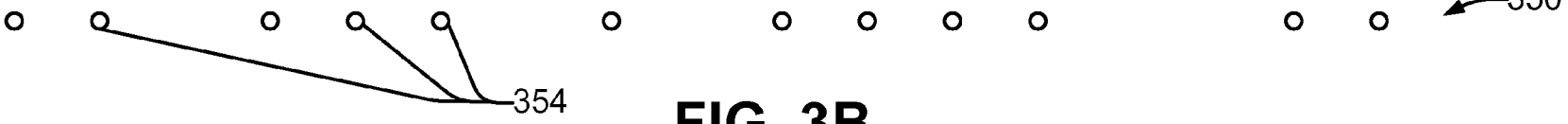
Figure 3C:
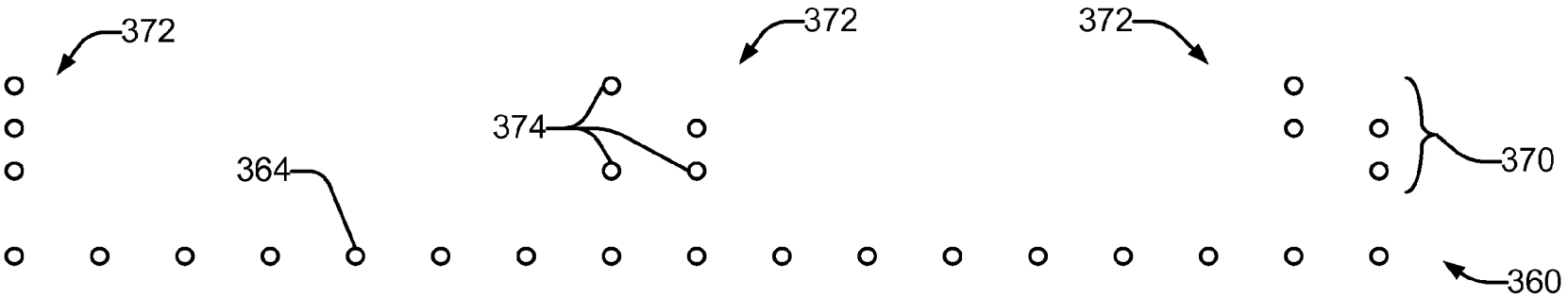

Considering now in further detail the pattern of the non-printed features formed on the media, and with further reference to FIGS. 3A-3C, the features may be arranged in a variety of patterns and in one or more lanes. In one pattern, and with reference to FIG. 3A, the non-printed features 344 in a single lane 340 on the media are formed in a regular pattern in which all the non-printed features 344 have the same feature-to-feature spacing in the down-web direction. The regular pattern formed by the features 344 can define encoder marks for a printing station, and/or for other processing stations down-web from the encoding station. A printing station may detect the features 344 and utilize them as encoder marks for generating the timing signals that control the printing at the desired resolution in the down-web direction.

In addition to serving as encoder marks, certain patterns of non-printed features can define indicia that identify corresponding regions of the media to a station downstream in the direction of the flow from the encoding station. In one such pattern, and with reference to FIG. 3B, the non-printed features 354 in a single lane 350 on the media are formed in a non-regular pattern in which the feature-to-feature spacing in the down-web direction can be different between different ones of the non-printed features 354. In some examples, the feature-to-feature spacing may be an integer multiple of a predefined spacing. An individual indicium may comprise a particular pattern of features 354 and spacings. The downstream station may detect the features 354, determine the indicia from the detected features 354, and then control a processing operation performed by the station based on the determined indicia. The indicia may be used to indicate, for example, where the media should be cut, which regions of the media correspond to front and back pages for registration, and the like.

In some examples, a single lane of non-printed features may be formed on the media. In other examples, and as understood with reference to FIG. 3C, plural lanes of non-printed features may be formed on the media. Lane 360 has a regular pattern of non-printed features 364 and can define encoder marks, similar to lane 340 of FIG. 3A. A lane set 370 has three individual lanes of non-printed features 374 arranged in a non-regular pattern that can define indicia that identify corresponding regions of the media. An individual indicium 372 of lane set 370 can be a two-dimensional pattern of features 374 in multiple lanes, and feature-to-feature spacings in both the down-web and cross-web directions. A multiple-lane indicial arrangement can communicate a larger set of indicia in a shorter down-web distance, provided that the station determining the indicia can detect the features 374 in the multiple lanes in parallel.

A single lane of non-printed features formed in a non-regular pattern, such as lane 350 of FIG. 3B, can in some examples serve to define, to a station downstream from the encoding station, encoder marks in addition to indicia that identify corresponding regions of the media, even though encoder marks typically use a regular pattern of features. This will be discussed subsequently with reference to FIG. 6.

Figure 4A:
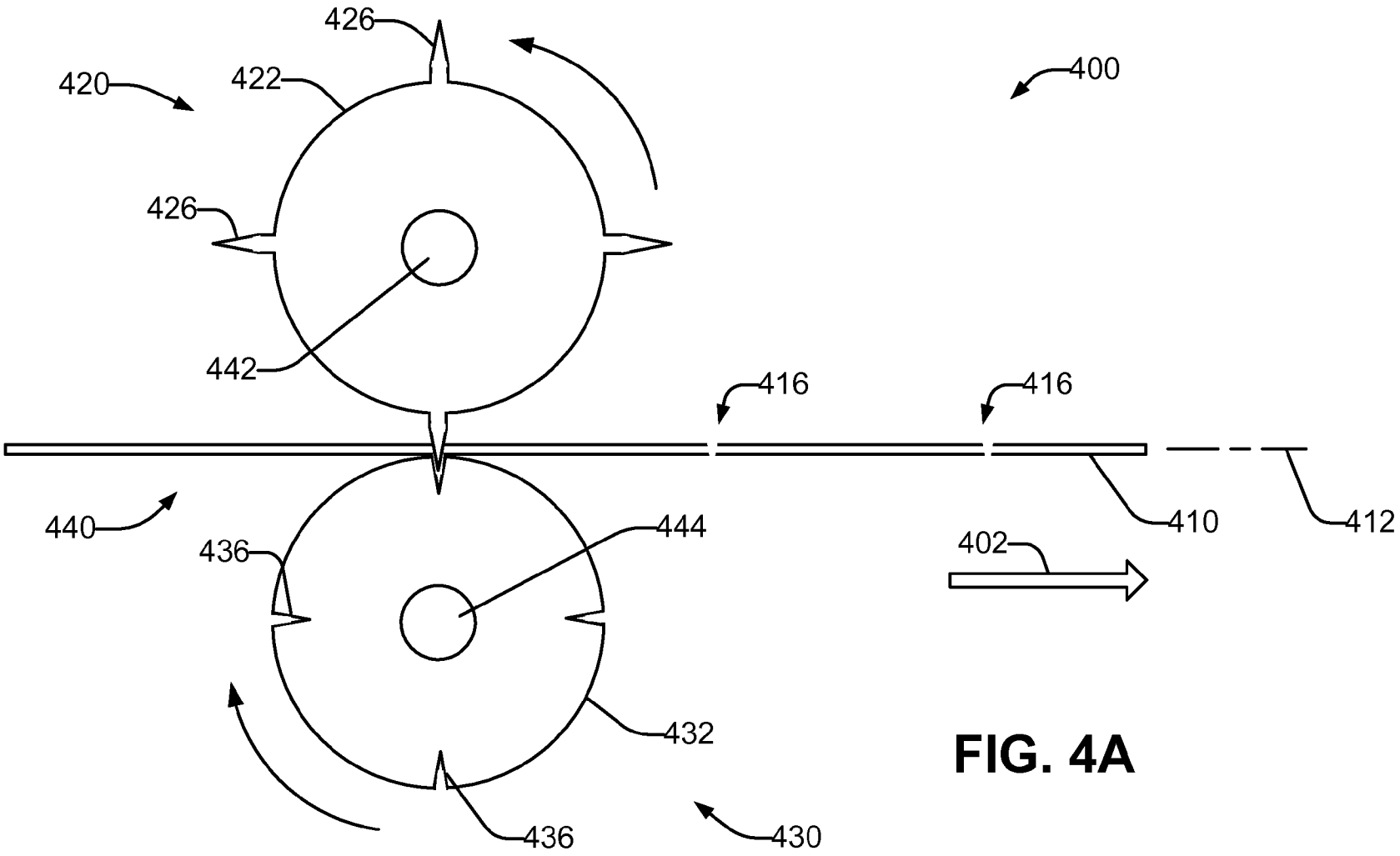
FIG. 4A is a schematic cross-sectional representation of an example mechanical patterning mechanism of an encoding station of the printing system of FIG. 1 for forming holes in media in accordance with an example of the present disclosure.

Considering now in greater detail an encoding station, which in one example may be the encoding station 120 (FIG. 1), the encoding station includes a patterning mechanism to form a pattern of non-printed features on the web of media as the media flows past the patterning mechanism in a flow direction 402. In some examples, the patterning mechanism may be a mechanical patterning mechanism. Considering a mechanical patterning mechanism that forms non-printed features as holes in the media, and with reference to FIG. 4A, a patterning mechanism 400 includes a rotary punch 420 having a wheel 422 and plural sharpened teeth 426 disposed at a cross-web position on one side of the media 410 such that the teeth 426 break the plane 412 of the media 410. For simplicity of illustration, four sharpened teeth 426 of the rotary punch 420 are illustrated; however, it can be appreciated that the punch 420 may include more or fewer teeth. In addition, the teeth 426 are illustrated as being equidistantly disposed around the circumference of the wheel 422, such that in operation the patterning mechanism 400 spaces the non-printed features apart from each other on the media in the flow direction 402 by substantially a same predetermined distance. However, in other examples the teeth 426 may be disposed around the circumference of the wheel 422 at different distances from each other, such that in operation the patterning mechanism 400 spaces the non-printed features apart from each other on the media in the flow direction 402 by a plurality of different distances. In some examples, each of the distances between two sharpened teeth 426 may be an integer multiple of a predetermined distance.

The patterning mechanism 400 also includes a rotary guide 430 having a wheel 432 and plural cutting holes 436, complementary to the sharpened teeth 426, disposed opposing the rotary punch 420 on an opposing side of the media 410 such that the cutting holes 436 receive the teeth 426. The rotary guide 430 is configured such that there is a cutting hole 436 for each of the teeth 426. In some examples, the guide 430 may include additional cutting holes 436; for example, the guide 430 may include cutting holes 436 equidistantly disposed around the circumference of the wheel 432 at a predetermined distance, while the teeth 426 may be disposed around the circumference of the wheel 422 of the rotary punch 420 at different distances from each other that are integer multiples of the predetermined distance.

In some examples, each of the teeth 426 may be a sharpened beveled tooth similar in shape to a dinking die. Each cutting hole 436 has a complementary shape. Each pair of teeth 426 and cutting holes 436 functions to cut a non-printed feature (i.e. a hole 416) in the media 410 as the tooth 426 breaks the plane 412 of the media 410 and pushes into the complementary cutting hole 436. The surface of the wheel 432 of the rotary guide 430 provides support for the cut, and assists in guiding a tooth 426 as it is running out of a cutting hole 436.

The size and shape of the holes 416 formed in the media 410 are determined by the dimensions of the sharpened teeth 426 and the cutting holes 436. The holes 416 may be circular, elliptical, square, rectangular, or some other shape. The sharpened teeth 426 and cutting holes 436 cooperate in a manner similar to a paper punch or scissors, with the point of a sharpened tooth 426 holding the media to be cut in place while the circumferential cut is performed to increase hole uniformity.

A drive mechanism coupled to the punch 420 and guide 430 rotates the wheels 422, 432 at a predefined rate relative to a velocity of the web of media 410 so as to punch the holes 416 in a lane on the media 410 during the rotation. The drive mechanism, indicated generally at 440, includes a first shaft 442 coupled to the wheel 422, and a second shaft 444 coupled to the wheel 432. In some examples, a motive source (not shown) drives both of the shafts 442, 444, while in other examples the motive source may drive one of the shafts, which in turn drives the other shaft.

In some examples, the shafts 442, 444 span some or all of the cross-web width of the media 410. The location of the rotary punch 420 and guide 430 along the span of the shafts 442, 444 defines the lane on the media 410 in which the holes 416 are formed. In some examples, the rotary punch 420 and guide 430 are disposed at a fixed position along the shafts 442, 444 respectively. In other examples, the rotary punch 420 and guide 430 may be disposed at a variable position along the shafts 442, 444 respectively.

In some examples, plural rotary punches 420 and complementary plural rotary guides 430 may be disposed at different positions along the span of the shafts 442, 444 in order to define multiple lanes on the media 410 in which the holes 416 are formed.

During operation, the wheels 422, 432 rotate in opposite directions. For example, where the flow direction 402 is from left to right in FIG. 4A, the rotary punch 420 above the media 410 rotates in the counterclockwise direction, while the rotary guide 430 below the media 410 rotates in the clockwise direction. In some examples, the predefined rate of rotation of the wheels may be chosen such that, while the tooth 426 is engaging with the cutting hole 436 to punch the hole 416 in the media 410, the linear velocity in the flow direction 402 of the tooth 426 and cutting hole 436 is substantially the same as the velocity of the web of media 410 in the flow direction 402, in order to form a smaller, more precise, and more accurate hole 416.

The diameter of the wheels 422, 432 can be larger or smaller than illustrated. In addition, while the wheels 422, 432 are illustrated as having substantially the same diameter, in some examples the diameter of each wheel may be different. In some examples where the teeth 426 are disposed at different distances from each other around the circumference of the wheel 422 of the rotary punch 420 in order to produce a non-regular pattern of holes 416 in a lane on the media 410, the diameter of at least the rotary punch wheel 422 may be selected so as to generate a particular repeating period for the non-regular pattern of holes 416. A larger diameter of the wheel 422 generates a longer repeating period of the holes 416.

It can be appreciated that chad produced by the hole punching operation of the patterning mechanism 400 may be cleared from the rotary guide 430, for example by air flow or gravity feed, and may be collected or otherwise disposed of.

Figure 4B:
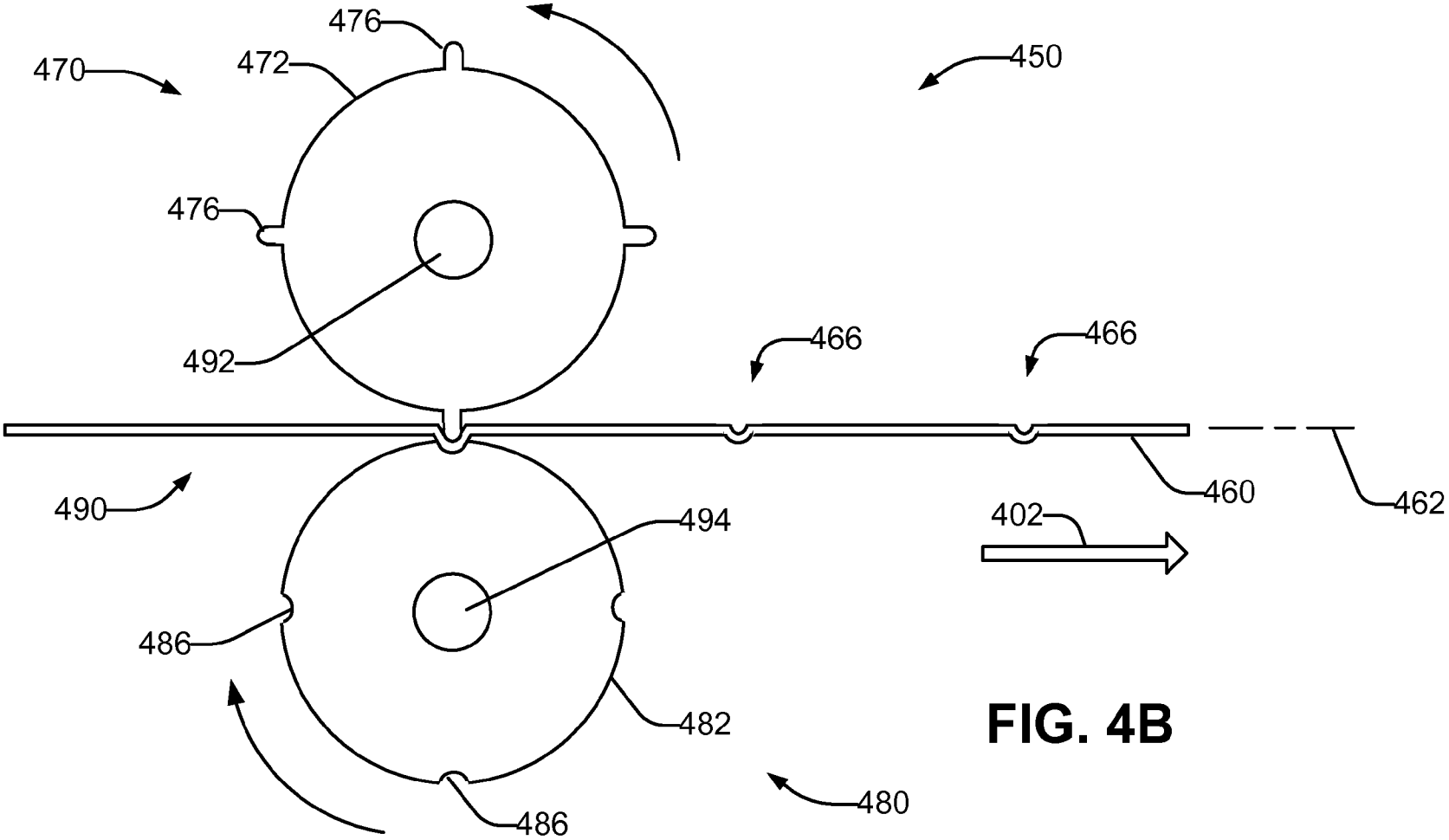
FIG. 4B is a schematic cross-sectional representation of an example mechanical patterning mechanism of an encoding station of the printing system of FIG. 1 for embossing bumps in media in accordance with an example of the present disclosure.

Considering now another mechanical patterning mechanism that forms non-printed features as holes in the media, and with reference to FIG. 4B, a patterning mechanism 450 includes a rotary die 470 having a wheel 472 and plural blunt teeth 476 disposed at a cross-web position on one side of the media 460 such that the blunt teeth 476 break the plane 462 of the media 460. For simplicity of illustration, four blunt teeth 476 of the rotary die 470 are illustrated; however, it can be appreciated that the die 470 may include more or fewer teeth. In addition, the teeth 476 are illustrated as being equidistantly disposed around the circumference of the wheel 472, such that in operation the patterning mechanism 450 spaces the non-printed features apart from each other on the media in the flow direction 402 by substantially a same predetermined distance. However, in other examples the teeth 476 may be disposed around the circumference of the wheel 472 at different distances from each other, such that in operation the patterning mechanism 450 spaces the non-printed features apart from each other on the media 460 in the flow direction 402 by a plurality of different distances. In some example, each of the distances between two blunt teeth 476 may be an integer multiple of a predetermined distance.

The patterning mechanism 400 also includes a rotary counter-die 480 having a wheel 482 and plural recesses 486, complementary to the blunt teeth 476, disposed opposing the rotary die 470 on an opposing side of the media 460 such that the recesses 486 receive the teeth 476. The rotary guide 480 is configured such that there is a recess 486 for each of the teeth 476. In some examples, the counter-die 480 may include additional recesses holes 486; for example, the counter-die 480 may include cutting holes 486 equidistantly disposed around the circumference of the wheel 482 at a predetermined distance, while the teeth 476 may be disposed around the circumference of the wheel 472 of the rotary die 470 at different distances from each other that, in some examples, are integer multiples of the predetermined distance.

Each of the blunt teeth 476 presses into the media 460 without cutting into it. Each recess 486 has a shape complementary to the blunt teeth 476. Each pair of teeth 476 and recesses 486 functions to emboss a non-printed feature (i.e. a bump 466) in the media 460 as the tooth 476 breaks the plane 462 of the media 460 and pushes into the complementary recess 486. The surface of the wheel 482 of the counter-die 480 provides support for the embossing operation, and assists in guiding a tooth 476 as it is running out of a recess 486.

The size and shape of the bumps 466 formed in the media 460 are determined by the dimensions of the blunt teeth 476 and the recesses 486. The bumps 466 may be circular, elliptical, square, rectangular, or some other shape.

A drive mechanism coupled to the die 470 and counter-die 480 rotates the wheels 472, 482 at a predefined rate relative to a velocity of the web of media 460 so as to emboss the bumps 466 in a lane on the media 460 during the rotation. The drive mechanism, indicated generally at 490, includes a first shaft 492 coupled to the wheel 472, and a second shaft 494 coupled to the wheel 482. In some examples, a motive source (not shown) drives both of the shafts 492, 494, while in other examples the motive source may drive one of the shafts, which in turn drives the other shaft.

In some examples, the shafts 492, 494 span some or all of the cross-web width of the media 460. The location of the die 470 and counter-die 480 along the span of the shafts 492, 494 defines the lane on the media 460 in which the bumps 466 are formed. In some examples, the die 470 and counter-die 480 are disposed at a fixed position along the shafts 492, 494 respectively. In other examples, the die 470 and counter-die 480 may be disposed at a variable position along the shafts 492, 494 respectively.

In some examples, plural dies 470 and complementary plural counter-dies 480 may be disposed at different positions along the span of the shafts 492, 494 in order to define multiple lanes on the media 460 in which the bumps 466 are formed.

During operation, the wheels 472, 482 rotate in opposite directions. For example, where the flow direction 402 is from left to right in FIG. 4B, the die 470 above the media 460 rotates in the counterclockwise direction, while the counter-die 480 below the media 460 rotates in the clockwise direction. In some examples, the predefined rate of rotation of the wheels may be chosen such that, while the tooth 476 is engaging with the recess 486 to emboss the bump 466 in the media 460, the linear velocity in the flow direction 402 of the tooth 476 and recess 486 is substantially the same as the velocity of the web of media 460 in the flow direction 402, in order to form a smaller, more precise, and more accurate bump 466.

The diameter of the wheels 472, 482 can be larger or smaller than illustrated. In addition, while the wheels 472, 482 are illustrated as having substantially the same diameter, in some examples the diameter of each wheel may be different. In some examples where the teeth 476 are disposed at different distances from each other around the circumference of the wheel 472 of the die 470 in order to produce a non-regular pattern of bumps 466 in a lane on the media 460, the diameter of at least the die wheel 472 may be selected so as to generate a particular repeating period for the non-regular pattern of bumps 466. A larger diameter of the wheel 472 generates a longer repeating period of the bumps 466.

Figure 5A:
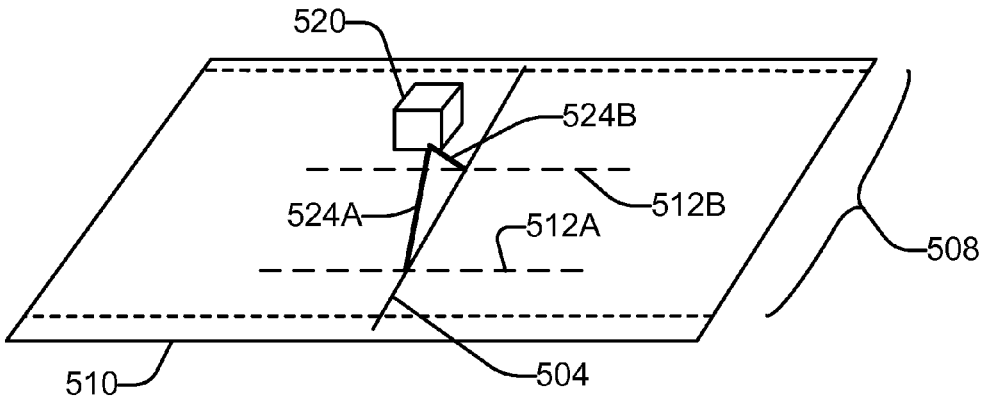
FIGS. 5A-5C are schematic representations of another example laser patterning mechanism of an encoding station of the printing system of FIG. 1 for forming holes in media in accordance with an example of the present disclosure.
Figure 5B:
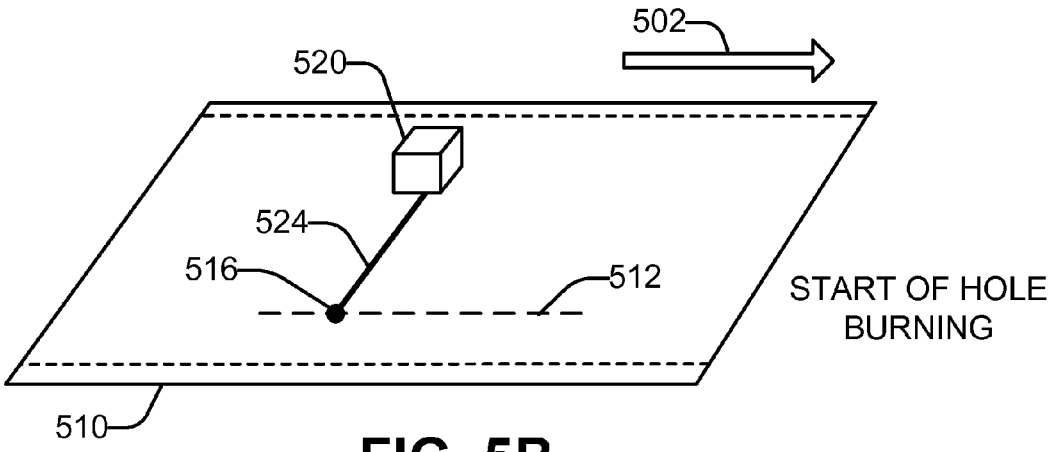
Figure 5C:
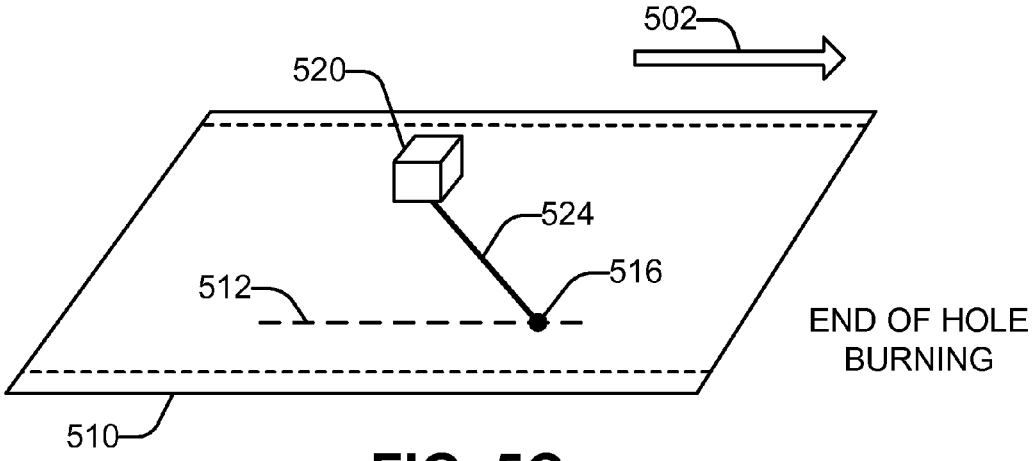

Considering now a laser patterning mechanism that forms non-printed features as holes in the media, and with reference to FIGS. 5A-5C, a patterning mechanism 500 has a laser 520 to form the features by selectively applying laser energy to desired locations on the flowing media in order to burn a desired pattern of holes in the media 510.

As can be appreciated with reference to FIG. 5A, the laser 520 generates a beam 524 that is positionable in a cross-web direction 504 to define a lane 512 on the media for the features 510, such as for example lane 512A or lane 514B. For example, a signal can be applied to a galvanometer of the laser 520 which, in conjunction with a system of optical components such as mirrors, positions the beam in the cross-web direction 504. In some examples, the laser 520 can generate multiple beams 524, such as beams 524A and 524B for example, for forming multiple lanes 512A, 512B of non-printed features. For example, a galvanometer can steer the laser beam 524 in the cross-web direction 504 to produce multiple lanes, by iteratively positioning the beam back and forth between two lanes or among several lanes. This allows one or more lanes 512 to be formed at a wide range of cross-web positions inside or outside a printable area 508 (indicated by dashed lines) of the media 510.

In addition, and as can be appreciated with reference to FIGS. 5B-5C, the laser beam 524 is positionable in a down-web direction 506 to maintain the laser beam 524 at an intended location 516 on the flowing media 510 during a hole forming operation. Consider an example in which the media 510 is moving in the direction of media flow 502 at a particular linear velocity. In order to accurately burn a hole at the intended location 516 on the flowing media 510, the laser beam 524 can be swept in the direction of media flow 502 (i.e. the down-web direction) in such a manner as to maintain the beam 524 impinging the intended location 516 on the media 510 throughout the duration of a hole burning operation. For example, at the start of the hole burning operation, the laser beam 524 is positioned on location 516 as in FIG. 5B, while at the end of the hole burning operation, the laser beam 524 is positioned on location 516 as in FIG. 5C. Stated another way, the laser beam 524 is swept in the direction of media flow 502 during the hole burning operation such that the linear velocity of a position on the media 510 that is impinged by the laser beam 524 is substantially the same as the linear velocity as the media 510 in the direction of media flow 502. In some examples, a signal can be applied to a galvanometer of the laser 520 which, in conjunction with a system of optical components such as mirrors, can sweep the beam in the direction of media flow 502.

The laser 520, in one example, may be a 100 watt laser. One suitable laser is the Pulstar P100, from Synrad, Inc. To burn a hole, the laser beam 524 is applied at a power and for a pulse time suitable to the particular type of media into which the holes are burned.

It can be appreciated that the laser patterning mechanism 500 can produce either a regular or non-regular pattern of non-printed features on the media 510. The non-regular pattern can have a repeating period if desired, but the non-regular pattern can alternatively be a non-repeating pattern.

Figure 6:
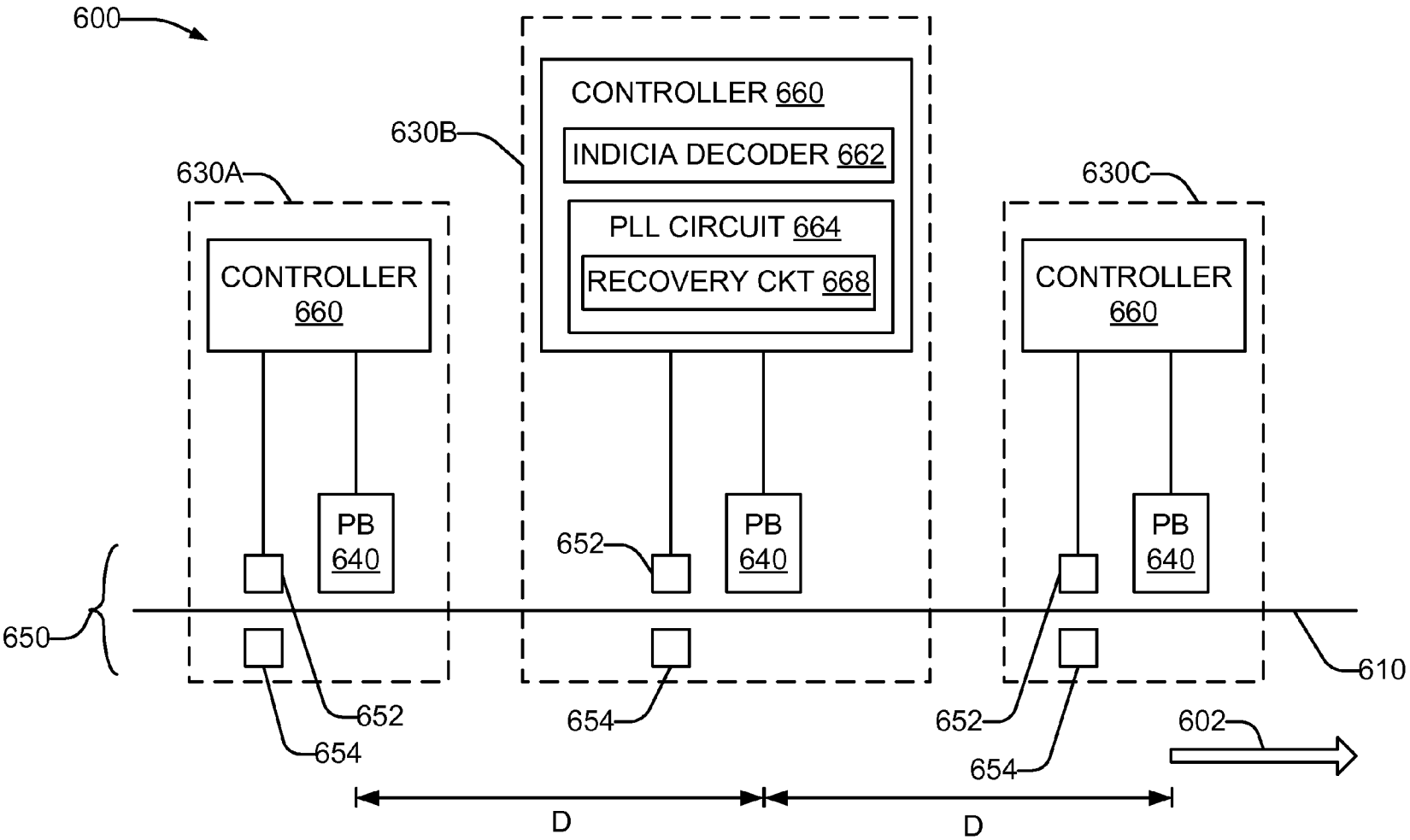
FIG. 6 is a schematic representation of an example printing station having plural printing assemblies of the printing system of FIG. 1 in accordance with an example of the present disclosure.

Considering now in greater detail a printing station, which in one example may be the printing station 130 (FIG. 1), and with reference to FIG. 6, a printing station includes one or more printing assemblies. The example printing station 600 includes three printing assemblies 630, denoted 630A-C, for printing on a web of media 610 having non-printed features formed by an upstream encoding station as the media 610 is transported through the printing station 600 in the direction of flow 602. While three printing assemblies 630 are illustrated for simplicity, it can be appreciated that a printing station may contain more or fewer printing assemblies 630. For example, a printing station having four colorants (black, cyan, magenta, and yellow) may have two printing assemblies 630 for each color of colorant, plus additional printing assemblies 630 for depositing other substances such as, for example, a bonding agent or ink that is suitable for magnetic ink character recognition (MICR). It can also be appreciated that while the path of the media 610 through the printing station 600 is illustrated as a linear path for simplicity, the media path can have a variety of shapes. For example, in some printing stations the media 610 may follow a curved, arched, or serpentine media path. In one example four colorant system, the printing assemblies 630 may be disposed along a ten foot arch within the printing station 600.

The printing station 600 receives from the encoding station the media 610 that has the pattern of non-printed features which has been formed on it by the encoding station. The printing station may be spaced apart from the encoding station. Within the printing station 600, each printing assembly 630 sequentially receives the media 610 for printing, as the media 610 flows through the printing station 600.

Each printing assembly 630 includes a printbar 640. The printbar 640 spans the width of the web of media 610, so that printing can be performed at any location in the cross-web direction within the printable width of the media 610. To this end, printing elements that are collectively capable of printing in the cross-web direction at the desired print resolution (e.g. dots per inch) are disposed along the printbar 640.

As has been described heretofore, some printbars employ thermal inkjet printing technology that uses a carrier for the colorants which is water-based, and thus the dots deposited on the media have significant water content. The water is absorbed by certain types of media, such as paper, causing the paper to expand and, when the water is later evaporated, to shrink somewhat. The media can also expand or contract due to tension changes in the web, for example. In the printing station 600, the printbars 640 of two printing assemblies 630 are spaced apart by a certain distance D along the media path. The distance D is the distance in the flow direction 602 along the media between two printbars 640. In a typical printing station, the distance D may range from five to ten inches. The distance D may be the same or different between different printbars 640. In one example printing station 600, the printbars 640 may all be spaced apart by a same distance of substantially one foot.

Since each printbar 640 adds its own colorant to the media 610 as it flows through the printing station 600 during a printing operation, the amount of expansion or contraction of the media 610 can be different at one printing assembly 630 of the printing station 600 to another printing assembly 630 of the station 600. As a result, each printing assembly 630 of the printing station 600 advantageously detects the non-printed features on the patterned media 610 at that printing assembly 630, and generates from the detected features the timing signals that cause the printbar 640 of that printing assembly 630 to print on the media at the desired resolution in the direction of the flow 602.

To this end, each printing assembly 630 includes a detector 650 to detect the non-printed features on the patterned media 610 as the patterned media flows past the detector 650. The detector 650 is typically positioned slightly upstream from the printbar 640 of the printing assembly 630, close enough so that the media expansion/contraction is substantially the same at the detector 650 as at the printbar 640, but far enough so that the output of the detector 650 can be used to control the printbar 640 to print colorant on the patterned media at a desired resolution in the flow direction.

In one example, a detector 650 usable to detect non-printed features which are holes in the media 610 is an optical detector. An optical detector 650 has an optical sensor 652 and a light source 654. The positioning of the optical sensor 652 and the light source 654 relative to the media 610 depends on the type of non-printed features to be detected. For non-printed features that are holes, the optical sensor 652 and the light source 654 are disposed on opposite sides of the media 610 in a transmissive-type detection arrangement. Usable light sources 654 include a laser light source or an LED light source. Where the web of media 610 is moving in the flow direction 602 at a high velocity, the optical sensor 652 may be a silicon sensor that includes a slit in the optical path that images a hole in the media onto the silicon sensor. A hole in the media 610 backlit by the light source 654 looks like a star in the sky to the sensor. The slit allows the position of the hole in the down-web direction to be determined very accurately by the sensor, and a corresponding high resolution (narrow) pulse to be generated by the detector 650 in response to detecting the hole. In some examples, the light from the light source 654 may be modulated to eliminate false detection due to ambient light in the printing station 600.

For non-printed features that are embossed bumps, the optical sensor 652 and the light source 654 are disposed on the same side of the media 610 in a reflective-type, or a combination reflective/absorptive-type, detection arrangement.

A detector 650 usable to detect non-printed features which are embossed bumps in the media 610 is typically a reflective-type detector 650. In one reflective-type detector, the optical sensor 652 and the light source 654 are both disposed on the same side of the media 610. This could be either the side of the media 610 from which the bump protrudes (e.g. a "peak"), or the side of the media 610 in which the bump is recessed (e.g. a "pit"). The light source 654 is typically projected toward the feature at an angle, such that the peak or pit forms a shadow. In the case of a pit, the sensor 652 can detect that the pit is illuminated less brightly than the flat surface of the media 610. In the case of a peak, the sensor 652 can detect that the peak is illuminated more brightly than the flat surface of the media 610, or that the peak casts a shadow that is illuminated less brightly than the flat surface of the media 610.

One alternative detector 650 may employ a light source 654 that emits two laser beams (diodes or gas), or a single split beam. One beam is directed where the bumps appear, and the other close to where the bumps appear, such as a cross-web position slightly offset from the lane in which the bumps are formed. Reflection from both beams are monitored by the sensor 652 and the wavelengths of the reflections are compared. When a bump reflects light back from one of the beams, a slight wavelength difference between the two returned light beams results, indicating the detection of a bump. The difference in reflected wavelength is caused by the slight difference in the distance from the flat media surface to the detector as compared to the distance from the bump to the detector. A high resolution pulse can be generated by the detector 650 in response to detecting the wavelength distance, indicating the detection of the bump.

Another alternative detector 650 may use a form of Interferometer, such as for example a Jamin Interferometer, in which the light source 654 emits parallel beams that run parallel to the media, are spaced apart by a distance greater than the minimum distance between bumps, and the parallel beam pair is positioned about at about a −45 degree angle with respect to the lane of bumps. As the media 610 flows in the direction 602, the parallel beams will be alternately interrupted by the bumps, and the sensor 652 observing the interference pattern or beam intensity produces a bipolar signal as a single bump breaks each of the beams in succession. The bipolar signal can serve as a high resolution pulse generated by the detector 650 in response to the detection of the bump.

The detector 650 is positioned adjacent the lane on the media 610 in which the non-printed features are formed. If the cross-web position of the lane is fixed, a fixed detector 650 may be employed. However, if the cross-web position of the lane is adjustable, an adjustable detector 650 that can be positioned at the corresponding cross-web position is employed. Where multiple lanes of non-printed features are formed on the media 610, as for example in FIG. 3C, then the printing assembly 630 includes a corresponding number of detectors 650, with one detector 650 assigned to each lane.

Each printing assembly 630 also includes a printbar controller 660 to generate, from the features detected by the detector 650, timing signals to cause the printbar 640 to print colorant on the patterned media 610 at a desired printed output resolution in the flow direction 602. The pulses output by the detector 650 are communicated to the controller 660, which in turn generates the timing signals for the printbar 640. Each timing signal received by the printbar 640 causes a single row of dots having a particular cross-web position to be printed on the media 610.

Typically, the non-printed features are spaced apart in the flow direction 602 on the media 610 by a much greater distance than the desired print output resolution in the flow direction 602. For example, a typical desired print output resolution may be 600 dots-per-inch (dpi). However, the non-printed features may be spaced apart on the media 610 by a minimum distance (for closest adjacent features) of between 0.1 inches and 0.5 inches. The minimum distance may be based on a number of factors, including maintaining the physical integrity of the web of media 610 and minimizing the visibility to the human eye of the non-printed features, particularly when those features are positioned within the printable area of the media 610.

As a result of this spacing of non-printed features, each pulse received by the controller 660 from the detector 650 generates in turn a number of timing signals to the printbar 640. For example, assume that the non-printed features are formed in a regular pattern on the media 610, with all the features spaced apart by the same distance of 0.5 inches. Put another way, the features are patterned on the media 610 at a feature density of 2 features-per-inch. In order to perform 600 dpi printing in response to this feature pattern, the controller 660 effectively generates 300 (=600/2) timing signals to the printbar 640 in response to each detected feature. These 300 timing signals may be generated in a variety of ways. For example, the controller 600 may generate 75 cycles of a 150 cycle-per-inch quadrature signal (two signals out of phase by 90 degrees from the other) to the printbar 640, which in turn derives four timing signals from each quadrature cycle.

The frequency or period at which the controller 660 generates the timing signals to the printbar 640 is dependent on the amount of time that elapses between the detection, by the detector 650, of two adjacent non-printed features on the media 610. Assume that the elapsed time between the detection of the two features is time T. For a feature spacing of 0.5 inches, the 300 timing signals each have a period of T/300. In the case of quadrature signals, the 75 cycles each have a period of T/75. In general, the period of the timing signals generated by the controller 660 can be characterized as time/N, where N is a scale factor that relates a distance on the media 610 between two closest adjacent features to the desired printed output resolution.

In some examples, the controller 660 has a phase-locked-loop (PLL) circuit 664 which measures the time between the detection of two adjacent features and generates the timing signals to the printbar 640. The phase-locked-loop circuit 664 recalculates the period of the timing signals each time a next non-printed feature is detected. In this way, and as will subsequently be explained in greater detail with reference to FIG. 7, the controller 660 operates to continually make adjustments in the timing signals to reduce or eliminate deviations in the print resolution of the printed output from the desired resolution due to the expansion or contraction of the media 610.

The above-described example of generation of the timing signals to the printbar 640 by the controller 660 assumed that the non-printed features were formed in a regular pattern on the media 610, with all the features spaced apart by the same distance, as in the lane 340 (FIG. 3A). However, in some examples, the controller 660 can also generate the timing signals to the printbar 640 where the non-printed features are formed in a non-regular pattern on the media 610, where a distance on the media between two adjacent features is an integer multiple of the distance between the two closest adjacent features, as in the lane 350 (FIG. 3B). The phase-locked-loop circuit 664 includes a recovery circuit 668 that compensates for an absent feature at the integer multiples—in other words, for the increased distance on the media 610 between the two adjacent features—so as to continue to generate proper timing signals. If a pulse from the detector 650 is not received at or near the expected time, the recovery circuit 668 simulates or recovers the missing pulse in order to allow the PLL 664 to continue to generate the timing signals to the printbar 640. Since the timing of the recovered pulse is derived from the previous pulses rather than from a detected pulse that indicates the actual present velocity of the media 610, the non-regular pattern is typically limited to distances between features which are low multiples of the closest distance. In other words, the non-regular pattern is defined such that a small number of consecutive features are omitted. In some examples, the maximum number of consecutive omitted features is two <correct?> or fewer. As can be appreciated, the recovery circuit 668 also operates to allow the PLL 664 to continue to generate the timing signals to the printbar 640 in circumstances where an intended features is missing, defective, or for some reason not detected. This may occur, for example, if a hole is blocked or a bump is flattened.

The controller 660 may also include an indicia decoder 662. As has been described heretofore, a non-regular pattern of the non-printed features can define indicia that identify corresponding regions of the media 610. The indicia decoder 662 determines the indicia from the pulses corresponding to the detected non-printed features that are sent to the controller 660 by the detector 650. For multiple-lane indicia such as, for example, those illustrated in FIG. 3C, multiple detectors 650 provide pulses to the indicia decoder 662.

The controller 660 may control a processing operation of the printing assembly 630 based on the determined indicia. For example, data to be printed may include a code which indicates that it should be printed at a region of the media 610 at which a certain indicia is present, and thus the controller 600 may verify that the indicia matches the code. This technique could be used, as an example, when printing bank statements, to ensure that the particular person whose statement was intended to be printed at a media region denoted by code X actually was printed at that region.

While the indicia decoder 662 has been described with reference to a printing station 600, it can be appreciated that the indicia decoder 662 can be utilized in other types of processing stations located downstream in the flow direction 602 from the encoding station. Such processing stations may, for example, perform operations other than printing, such as cutting, registration of front and back pages, or other functions.

Figure 7:
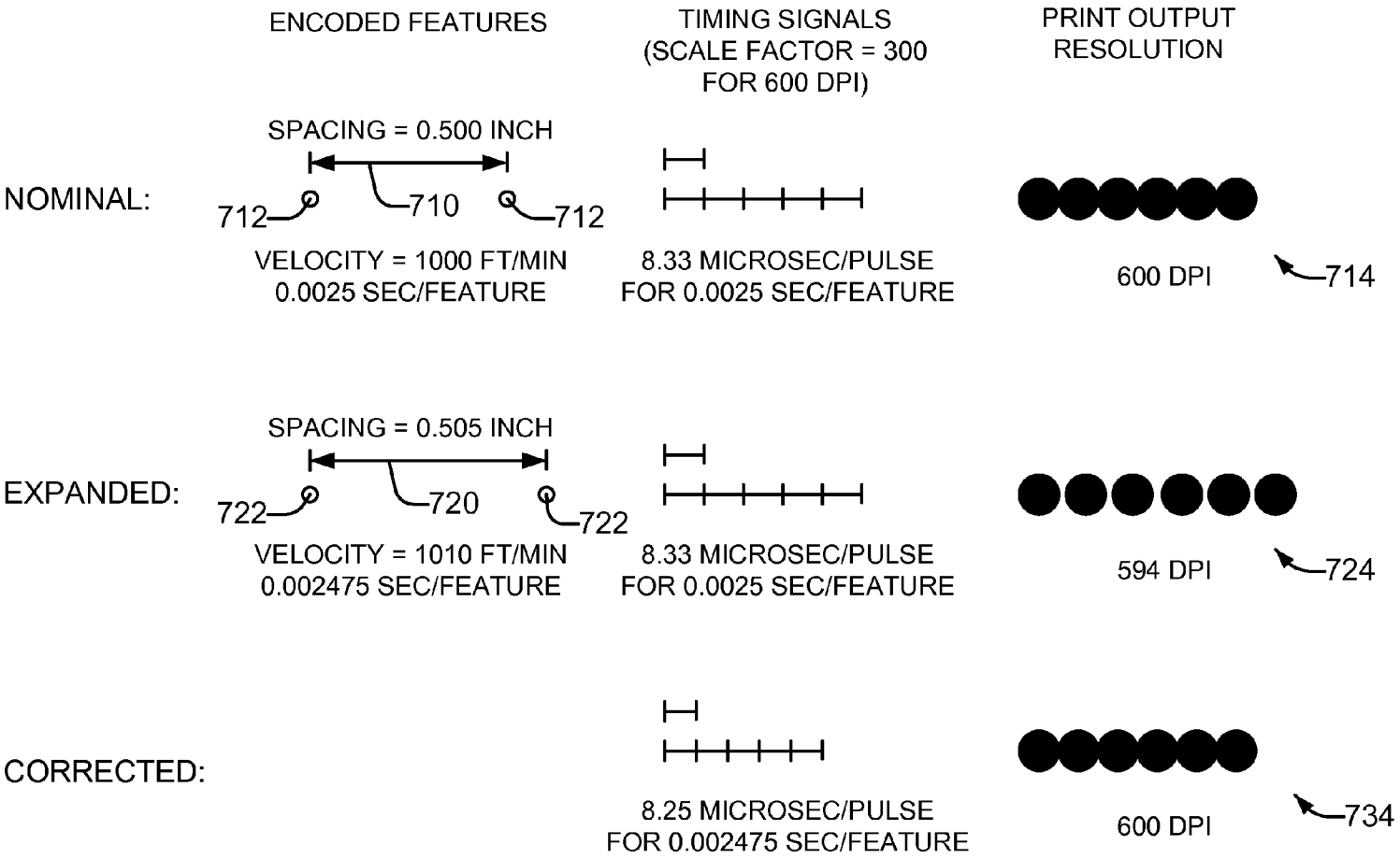
FIG. 7 is a schematic representation of a change in print output resolution resulting from expansion in the down-web direction of the web of media in the printing system of FIG. 1, and a technique to correct the print output resolution to the intended resolution in accordance with an example of the present disclosure.

Considering now, and with reference to FIG. 7, the effect on print resolution of media expansion in the direction of media flow, and correction for such media expansion so as to produce print output at the desired resolution in the direction of media flow, assume that a resolution of 600 dpi in the direction of media flow is desired. Furthermore, assume that a regular pattern of non-printed features, formed on the web of media by an upstream encoding station, has a nominal spacing 710 of 0.500 inches between each two features 712 in a lane on the media. In addition, assume that the media is flowing through the printing assemblies of a printing station, such as for example printing assemblies 630 of printing station 600, at a nominal velocity of 1000 feet/minute. At this nominal velocity, the detector 650 of a printing assembly 630 directed at the lane will detect 400 features each second. Stated inversely, a feature will be detected every 0.0025 second.

Assume that the controller 660 of the printing assembly 630 has a scale factor N of 300. Therefore, to produce printed output 714 at 600 dpi resolution in the direction of media flow, the controller 660 generates a timing signal to the printbar 640 of the printing assembly 630 every 0.0025/300=8.33 microseconds. It can be appreciated that the dots shown in the printed output is representative of dot positions; whether any colorant is deposited on the dot position depends on the actual print data sent to the printbar 640.

As has been described heretofore, the deposition of colorant on the media may cause the media to expand. The media expansion both increases the spacing between the non-printed features, and effectively adds to the velocity of media web in the direction of media flow. Assume, for purposes of illustration, that the colorant causes the media to expand by 1% in the direction of media flow. This results in an expanded spacing 720 of 0.505 inches between each two features 722 in the lane on the media. In addition, the velocity of the media flow in the direction of flow is effectively increased by 1% to 1010 feet/minute. If this increased velocity is not compensated for, and the controller 660 continues to generate a timing signal to the printbar 640 every 8.33 microseconds, the spacing of colorant dots on the printed output 724 produced by the printing assembly 630 will also be increased by 1%, resulting in a printed output resolution that is correspondingly decreased by 1%, to 594 dpi. This may disadvantageously result in lower perceived print quality due to more white space between dots of colorant. Furthermore, in a printing station having multiple printing assemblies 630, the difference in media expansion from printing assembly to printing assembly as each adds more colorant to the media can cause the dots printed by different assemblies to misalign. The misalignment also reduces print quality. It may be particularly noticeable in a color printing station where different printing assemblies 630 deposit different color colorants, with the misalignment also causing color shifts or distortions. Furthermore, while a relatively small change in printed output resolution may not be especially noticeable to the human eye if all regions of the printed media have the same resolution, the addition of colorant at each print assembly 630 can cause the resolution of the printed output to vary from region to region in the direction of media flow.

To correct for media expansion so as to produce print output at the desired resolution in the direction of media flow on all regions of the media, the controller 660 measures the time between the detection of adjacent non-printed features, and adjusts the period of the timing signals accordingly. Using the above example of a 1% increase in web velocity due to media expansion, at an increased velocity of 1010 feet/minute the detector 650 will detect 404 features each second. Stated inversely, a feature will be detected every 0.002475 second. The controller 660 applies the scale factor N of 300 to this period, and generates a timing signal to the printbar 640 of the printing assembly 630 every 0.002475/300=8.25 microseconds. As the period of the timing signals has been adjusted based on the actual web velocity, the resulting print output 734 has the intended resolution of 600 dpi resolution in the direction of media flow. By a controller 660 individually performing this adjustment at each printing assembly 630 of a printing station 600, printed output at substantially the intended resolution can be achieved throughout the media web.

While the correction for media expansion has been described here with regard to a regular pattern of non-printed features in a lane of the media, it can be appreciated that the correction can also be performed with non-printed features of a non-regular pattern, employing the recovery circuit 688 of the controller 660 as has been previously described.

It can also be appreciated that the correction operation described here can also compensate for velocity changes in the web that are due to causes other than media expansion/contraction, such as for example velocity variation in the mechanism that flows the media web through the printing system, run-out of media on the rollers, and the like.

Figure 8:
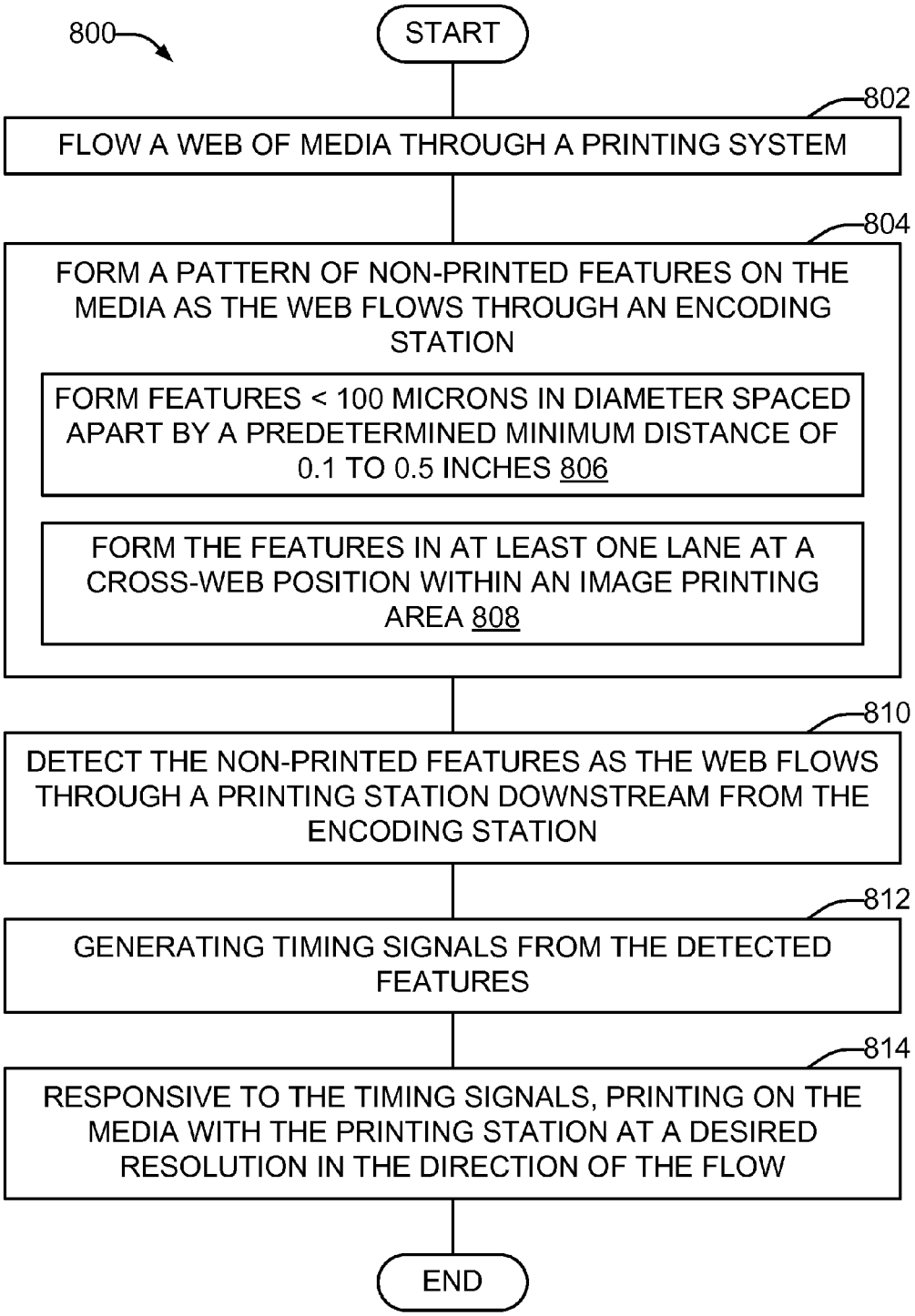
FIG. 8 is a flowchart of a method of printing in accordance with an example of the present disclosure.

Consider now, with reference to FIG. 8, a flowchart of a method of printing with a printing system. The printing system may, in some examples, be the printing system 100 (FIG. 1) or 600 (FIG. 6). A method 800 begins at 802 by flowing a web of media through the printing system. At 804, a pattern of non-printed features is formed on the media as the web flows through an encoding station of the printing system. In some examples, at 806, non-printed features less than 100 microns in diameter spaced apart by a predetermined minimum distance of between about 0.1 inch to 0.5 inch are formed. In some examples, at 808, non-printed features are formed in at least one lane disposed at a cross-web position located within a content printing area of the media. At 810, the non-printed features are detected as the web flows through a printing station of the printing system. The printing station in located in the printing system downstream from the encoding station of the printing system. At 812, timing signals are generated from the detected features. At 814, responsive to the timing signals, the media is printed on with the printing station at a desired print output resolution in the direction of the flow of the media through the printing system.

From the foregoing it will be appreciated that the printing systems and methods provided by the present disclosure represent a significant advance in the art. Although several specific examples have been described and illustrated, the disclosure is not limited to the specific methods, forms, or arrangements of parts so described and illustrated. For example, examples of the disclosure are not limited to thermal inkjet printing technology. As another example, while correction for media expansion/contraction in the down-web direction has been described, it will be appreciated that multiple lanes of non-printed features formed on the media at a predetermined spacing between lanes can be used to correction for media expansion/contraction in the cross-web direction. Optical detectors, such as the detectors 650, that detect the features in the multiple lanes can be repositioned in the cross-web direction as appropriate to continue to track the lane as the media expands/contracts in the cross-web direction. The distance in the cross-web direction between the sensors can be compared to the predetermined spacing between the lanes, and the deviation used to adjust the timing of firing signals in the printbars that control the placement of dots in the cross-web direction, in an analogous manner to that which has been heretofore described with reference to FIG. 7 for the down-web direction. In yet another example, the media may not flow directly from encoding station to the printing station; instead, the encoded media may be rolled up onto a roller, and the printing station may draw the media from the roller. This can allow the encoding station and the printing station to be operated at different times and in different locations.

This description should be understood to include all novel and non-obvious combinations of elements described herein, and claims may be presented in this or a later application to any novel and non-obvious combination of these elements. The foregoing examples are illustrative, and no single feature or element is essential to all possible combinations that may be claimed in this or a later application. Unless otherwise specified, steps of a method claim need not be performed in the order specified. Similarly, blocks in diagrams or numbers (such as (1), (2), etc.) should not be construed as steps that necessarily proceed in a particular order. Additional blocks/steps may be added, some blocks/steps removed, or the order of the blocks/steps altered and still be within the scope of the disclosed examples. Further, methods or steps discussed within different figures can be added to or exchanged with methods or steps in other figures. Further yet, specific numerical data values (such as specific quantities, numbers, categories, etc.) or other specific information should be interpreted as illustrative for discussing the examples. Such specific information is not provided to limit examples. The disclosure is not limited to the above-described implementations, but instead is defined by the appended claims in light of their full scope of equivalents. Where the claims recite "a" or "a first" element of the equivalent thereof, such claims should be understood to include incorporation of one or more such elements, neither requiring nor excluding two or more such elements.

What is claimed is:

1. A printing system, comprising:

an encoding station to receive a flow of media and form a pattern of non-printed features on the media within a content printing area of the media; and a printing station to receive the flow of media from the encoding station, detect the features, and generate from the detected features timing signals that cause the printing station to print user content on the media, over at least some of the non-printed features, at a desired resolution in the direction of the flow.

2. The system of claim 1, wherein each feature is less than about 100 microns in diameter and wherein closest adjacent features are spaced apart by a predetermined distance of between about 0.1 inch to 0.5 inch.

3. The system of claim 1, wherein the non-printed features are formed on the media in at least one lane, each lane at a cross-web position within the content printing area of the media.

4. The system of claim 1, wherein the pattern of the non-printed features further defines an indicium that identifies a corresponding region of the media, and wherein a station downstream from the encoding station determines the indicium from the detected features and controls, based on the determined indicium, a processing operation of the downstream station, the processing operation not related to generating the timing signals.

5. The system of claim 1, wherein the non-printed features in a first lane on the media are formed in a regular pattern that defines encoder marks for the printing station.

6. The system of claim 5, wherein the non-printed features in at least one second lane on the media are formed in a non-regular pattern that defines indicia that identify corresponding regions of the media.

7. The system of claim 6, wherein the non-printed features that define the indicia are arranged in a two-dimensional pattern on the media.

8. The system of claim 1, wherein the non-printed features in a first lane on the media are formed in a non-regular pattern that defines both encoder marks for the printing station and indicia that identify corresponding regions of the media.

9. The system of claim 1, wherein the non-printed features on the media that are overprinted with the user content remain detectable by the printing system after being overprinted with the user content.

10. A printing system, comprising:

an encoding station to receive a continuous flow of media from a media supply;

a patterning mechanism in the encoding station to form a pattern of non-printed features within a content printing area of the media as the media flows past the patterning mechanism;

at least one printing assembly to receive the flow of the patterned media;

a detector in each printing assembly to detect the features on the patterned media as the patterned media flows past that detector; and a controller in each printing assembly to generate, from the detected features, timing signals to cause a printbar of the printing assembly to print colorant corresponding to user content on the patterned media over at least some of the non-printed features, at a desired resolution in the flow direction.

11. The system of claim 10, wherein the patterning mechanism comprises:

a laser to form the features by burning a pattern of holes in the media, the laser having a beam positionable in a cross-web direction to define a lane on the media for the features, and in a down-web direction to maintain the laser beam at an intended location on the flowing media during a hole burning operation by moving the laser beam in the flow direction at substantially the same linear velocity as the media.

12. The system of claim 10, wherein the patterning mechanism comprises:

a rotary punch having a wheel and plural sharpened teeth disposed at a cross-web position on one side of the media such that the teeth break the plane of the media;

a rotary guide having a wheel and plural cutting holes, complementary to the teeth, disposed opposing the rotary punch on an opposing side of the media such that the holes receive the teeth; and a drive mechanism coupled to the punch and guide that rotates the wheels at a predefined rate relative to a velocity of the media so as to punch holes in a lane on the media during the rotation.

13. The system of claim 10, wherein the patterning mechanism comprises:

a rotary die having a wheel and plural blunt teeth disposed at a cross-web position on one side of the media such that the teeth break the plane of the media;

a rotary counter-die having a wheel and plural recesses, complementary to the teeth, disposed opposing the rotary die on an opposing side of the media such that the recesses receive the teeth; and a drive mechanism coupled to the punch and guide that rotates the wheels at a predefined rate relative to a velocity of the media so as to emboss bumps in a lane on the media during the rotation.

14. The system of claim 10, wherein the patterning mechanism spaces the non-printed features apart on the media in the flow direction by substantially a same predetermined distance.

15. The system of claim 10, wherein the patterning mechanism spaces the non-printed features apart on the media in the flow direction by a plurality of different distances, each different distance an integer multiple of a predetermined distance.

16. The system of claim 10, wherein each feature is less than about 100 microns in diameter and wherein closest adjacent features are spaced apart by a predetermined distance of between about 0.1 inch to 0.5 inch.

17. The system of claim 10, wherein the non-printed features are formed on the media in at least one lane, each lane at a cross-web position within the content printing area of the media.

18. The system of claim 10, wherein the non-printed features on the media that are overprinted with the user content remain detectable by the printing system after being overprinted with the user content.

19. A method of printing, comprising:

flowing a web of media through a printing system;

forming a pattern of non-printed features on the media within a content printing area as the web flows through an encoding station of the system;

detecting the non-printed features as the web flows through a printing station of the system downstream from the encoding station;

generating timing signals from the detected features; and responsive to the timing signals, printing user content on the media, over at least some of the non-printed features, with the printing station at a desired resolution in the direction of the flow.

20. The method of claim 19, wherein the forming comprises forming features less than 100 microns in diameter spaced apart by a predetermined minimum distance of between about 0.1 inch to 0.5 inch on at least one lane disposed at a cross-web position within the content printing area of the media.

21. The method of claim 19, wherein the non-printed features on the media that are overprinted with the user content remain detectable by the printing system after being overprinted with the user content.

* * * * *